United States Patent [19]

Shimamura et al.

[11] Patent Number: 4,550,751

[45] Date of Patent: Nov. 5, 1985

[54] BALLAST EXHAUST PIPE CLOSING APPLIANCE FOR A SHIP

[75] Inventors: Hayato Shimamura, Yokohama; Osamitsu Maeda, Higashino, both of Japan

[73] Assignees: Misuzu Machineries & Engineering Ltd., Hyogo; Toner Tanker K.K., Tokyo, both of Japan

[21] Appl. No.: 442,437

[22] Filed: Nov. 17, 1982

[30] Foreign Application Priority Data

Nov. 17, 1981 [JP] Japan ..... 56-171547[U]

[51] Int. Cl.[4] ..... F16L 55/12

[52] U.S. Cl. ..... 138/93; 114/125

[58] Field of Search ..... 138/93; 114/125

[56] References Cited

U.S. PATENT DOCUMENTS

| | | | |
|---|---|---|---|
| 1,506,418 | 8/1924 | Evensta et al | 138/93 |
| 1,510,212 | 9/1924 | Du Bois | 138/93 |
| 3,870,085 | 3/1975 | Schneider | 138/93 |
| 4,144,908 | 3/1979 | Dunn | 138/93 |
| 4,373,381 | 2/1983 | Kulp et al. | 138/93 |

FOREIGN PATENT DOCUMENTS

| | | |
|---|---|---|
| 51-143297 | 12/1976 | Japan . |
| 52-118789 | 10/1977 | Japan . |

*Primary Examiner*—John W. Shepperd

*Attorney, Agent, or Firm*—Wenderoth, Lind & Ponack

[57] ABSTRACT

A ballast exhaust pipe closing appliance for a ship is so designed that a closing stopper comprising an inflatable bag body is inserted in a ballast exhaust pipe. By supplying compressed air in the closing stopper, the closing stopper is inflated and closes the ballast exhaust pipe, thereby preventing liquid which leaked in the ballast exhaust pipe from flowing into the sea. Also, the closing stopper can be removed automatically and fluid which leaked in the ballast exhaust pipe can be drawn out by exhausting compressed air in the closing stopper and by raising the air pressure in the ballast exhaust pipe.

1 Claim, 3 Drawing Figures

BALLAST EXHAUST PIPE CLOSING APPLIANCE FOR A SHIP

BACKGROUND OF THE INVENTION

1. Field of the Invention

This invention relates to a ballast exhaust pipe closing appliance for a ship, such as an oil tanker, a chemical tanker, etc., whereby closing temporarily an outward opening of the ballast exhaust pipe for preventing fluid, such as oil, water or the like, from leaking out of the ship through the outward opening.

2. Description of the Prior Art

Generally, one end of a higher ballast exhaust pipe for a ship communicates with a pump room in a hull and the other end of it opens outward from the hull in its outer side plate, passing through a partition plate which divides the pump room from a fuel tank room. A shutoff valve is fixed to the ballast exhaust pipe within the pump room so that when ballast is exhausted, it can be exhausted out of the ship by opening the shutoff valve.

However, it is sometimes experienced that even while the shutoff valve is closed, fluid leaks out of the outward opening of the ballast exhaust pipe due to leaks in the shutoff valve itself caused by corrosion by seawater, leakage of fuel oil from a defective part of the ballast exhaust pipe within the fuel tank room or other trouble. Such leakage of fluid, even if small in quantity, is not allowed legally so far as it occurs in a harbor or along the coast. In order to prevent such leakage of fluid into the sea, an emergency measure such as closing temporarily an outward opening of a ballast exhaust pipe with a wooden stopper, using a bonding agent or cement if necessary, has been taken. In this case, however, depending upon the draft of a ship, the outward opening of the ballast exhaust pipe will be below the surface of the water and much time and labor will be required for putting in and removing the stopper by sending down a diver, for example. Moreover, the conventional measure has such disadvantages that it is impossible to grasp the actual state of leakage and to locate the source of leakage.

SUMMARY OF THE INVENTION

In view of the above disadvantages of the conventional measure, the present invention has for its object to make the temporary closing of the outward opening of the ballast exhaust pipe more certain and more convenient, to improve the closing effect, to facilitate putting in and removing of a stopper and to make the cause of leakage easily detectable, so as to prevent fluid from leaking out of the outward opening of the ballast exhaust pipe.

In order to achieve the above object, the composition of the present invention is a closing appliance to close temporarily an outward opening of a ballast exhaust pipe with one end thereof communicating with a pump room in a hull and the other end thereof opening at an outer plate outward from the hull. This closing appliance comprises an inflatable, cylindrical bag body insertable in the outward opening and is equipped with a closing stopper having a communicating slender pipe to be passed through the central longitudinal axis of the bag body, a first feed and exhaust hose connected communicatably at one end face of the closing stopper with the bag body, a second feed and exhaust hose connected communicatably at one end face of the closing stopper with the communicating slender pipe, and a change-over control device which is connected to the other ends of said two feed and exhaust hoses and which controls switching of the feed and exhaust of compressed air for said two feed and exhaust hoses. In the case where the outward opening of the ballast exhaust pipe must be closed, firstly the closing stopper is inserted into the opening, the opening is closed hermetically by inflating the bag body by supplying compressed air to the first feed and exhaust hose, and fluid which leaked in the ballast exhaust pipe is drawn outside via the communicating slender pipe and through the second feed and exhaust hose. On the other hand, in the case where the opening need not be closed, the closing stopper can be taken out of the opening automatically by raising the air pressure in the ballast exhaust pipe with a supply of compressed air to the second feed and exhaust hose via the communicating slender pipe. By the operation of the change-over control device and by contracting the bag body, compressed air in the bag body is exhausted via the first feed and exhaust hose. In this connection, it is desirable to provide the bag body at its outer circumference with a proper number of annular belts, thereby ensuring maintenance of a cylindrical shape at the time of inflating and contracting of the bag body and enhancing the hermetical closing effect of the outward opening. In this case, however, fluid which leaked in the ballast exhaust pipe provided with the above-mentioned closing stopper cannot be drawn outside, unless leaked fluid fills up the ballast exhaust pipe and its pressure is higher than a rising water head pressure of the second feed and exhaust hose. Basically, it is impossible to draw out leaked fluid in the ballast exhaust pipe and accordingly, when taking off a closing stopper, there is the problem of leaked fluid in the ballast exhaust pipe flowing into the sea.

In view of the above, a further object of the present invention is to draw out leaked fluid in the ballast exhaust pipe in its entirety by raising the air pressure in the ballast exhaust pipe by compressed air, thereby preventing leaked fluid from flowing into the sea when taking off a closing stopper. For this purpose, in addition to the above-mentioned composition, the present invention is so designed that the other end of the communicating slender pipe opens facing the inner wall bottom part of the ballast exhaust pipe. Another communicating slender pipe for air supply is passed through the central longitudinal axis of the bag body substantially in parallel with the above-mentioned communicating slender pipe. This communicating slender pipe for the air supply is connected, with an air supply hose at one end of the closing stopper and said air supply hose is connected to the change-over control device at the other end thereof. With this arrangement, when the outward opening must be closed, compressed air is supplied to the air supply hose by operating the change-over control device and then by raising the air pressure in the ballast exhaust pipe via the communicating slender pipe for the air supply. Leaked fluid in the ballast exhaust pipe is drawn outside from the other end of the communicating slender pipe which opens facing the inner wall bottom part of the ballast exhaust pipe, via the second feed and exhaust hose.

BRIEF DESCRIPTION OF THE DRAWINGS

The nature and advantages of the present invention will be understood more clearly from the following description made with reference to the accompanying drawings, in which.

DETAILED DESCRIPTION OF PREFERRED EMBODIMENTS

Figure 1:
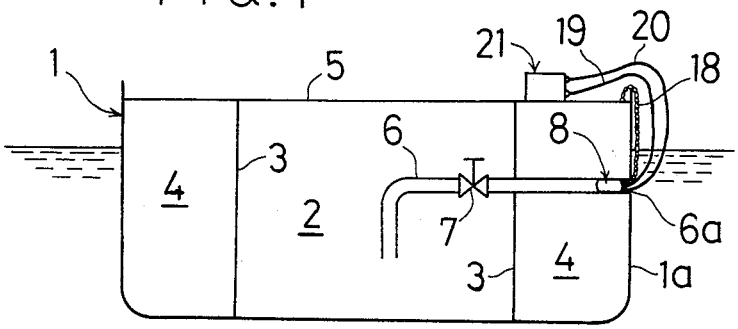
FIG. 1 shows a schematic composition of the first embodiment of the present invention.
Figure 2:
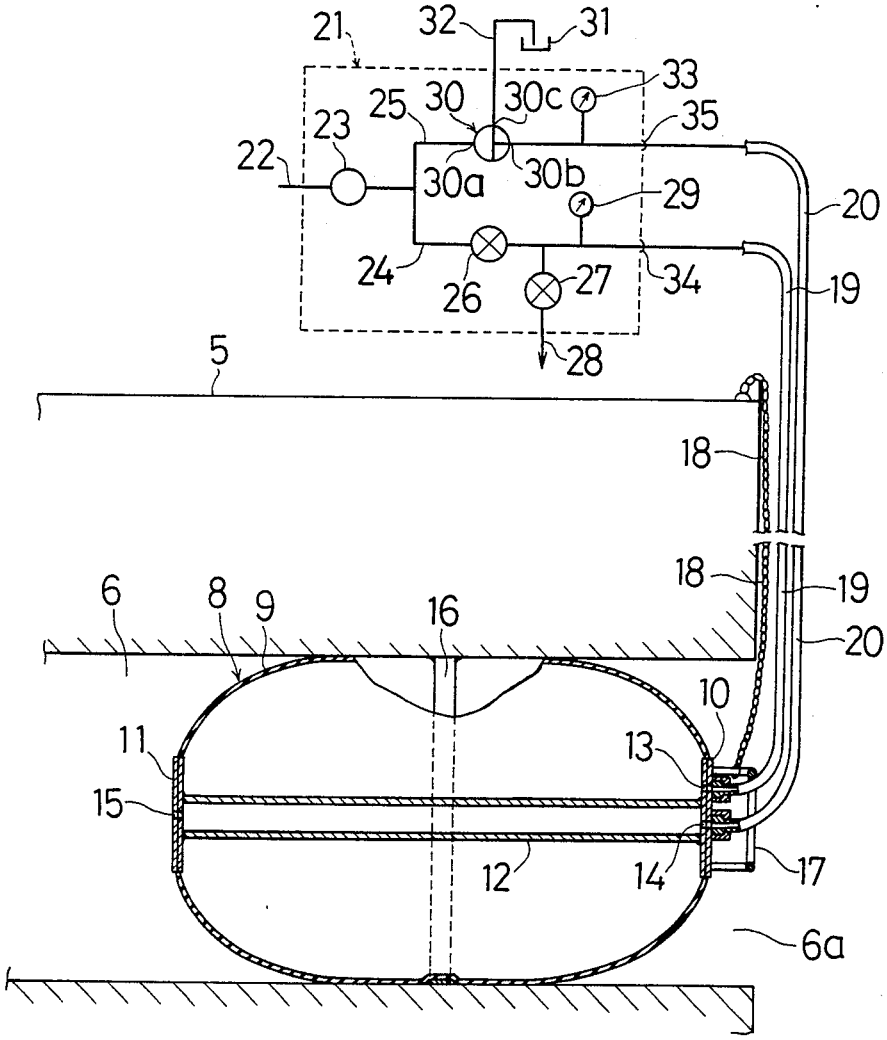
FIG. 2 shows the state in which a closing stopper is inserted and a compressed air feed and exhaust system therefor.

Referring first to FIG. 1 and FIG. 2 showing the first embodiment of the present invention, numeral 1 denotes a hull of a ship, such as an oil tanker, a chemical tanker or the like. Numeral 2 denotes a pump room partitioned by two partition plates 3 at the center of the section of said hull 1. Numeral 4 denotes fuel tank rooms partitioned at both sides of said pump room 2. Numeral 5 is an upper deck. Numeral 6 is a ballast exhaust pipe with one end thereof communicating with said pump room 2 and the other end thereof opening outward of the hull 1 at its outer side plate 1*a*, passing through the partition plate 3 and via the fuel tank room 4. Said ballast exhaust pipe 6 is provided with a shutoff valve 7 within the pump room 2 and is normally closed by the operation of said shutoff valve 7 but exhausts ballast by opening the ballast exhaust pipe 6 by operating the shutoff valve 7.

Numeral 8 is a closing stopper of cylindrical shape to be fixed at an outward opening 6*a* of the ballast exhaust pipe 6. This closing stopper 8 comprises an inflatable rubber bag body 9 (FIG. 2) of cylindrical shape having an outside diameter which is sized so that the bag body 9 is exactly insertable in the opening 6*a* and also having a proper length required for ensuring a sealing area. The closing stopper 8 further comprises flanges 10, 11 fixed at both end faces of the bag body 9 and a communicating slender pipe 12 passed through the central longitudinal axis of the bag body 9 and connecting both flanges 10, 11. Provided at the flange 10 (flange on the side facing outward of the ship) are a first connecting hole 13 communicating with the bag body 9 and a second connecting hole 14 communicating with the communicating slender pipe 12. Provided at the other flange 11 (flange on the side facing the inside of the ballast exhaust pipe 6) is a communicating hole 15 which communicates with the communicating slender pipe 12. Wound around the outer circumferential surface of the bag body 9 are a proper number of annular belts 16 (one in FIG. 2) having sponge within. This belt 16 is designed for keeping the bag body 9 in cylindrical shape when it inflates or contracts. The communicating slender pipe 12 not only serves as a communicating pipe but also serves to maintain the bag body 9 in regular length. The flange 10 is provided with an annular handle member 17 to facilitate the transport of the closing stopper 8. Connected to the annular handle member 17 is a binding member 18, such as rope, wire, etc., the other end of which is fixed to the upper deck 5 of the hull 1 so as to prevent the closing stopper 8 from flowing out and to facilitate pulling up the closing stopper 8 after it is removed.

Number 19 is a first feed and exhaust hose mainly comprising a pressure-resisting rubber hose connected at one end face (end face on the side facing outward of the ship) of the closing stopper 8 to the first connecting hole 13 in such a fashion that it communicates with the bag body 9. Numeral 20 is a second feed and exhaust hose mainly comprising a pressure-resisting rubber hose connected at one end face of the closing stopper 8 to the second connecting hole 14 in such a fashion that it communicates with the communicating slender pipe 12. The other ends of both feed and exhaust hoses 19, 20 are connected to a portable change-over control device 21 installed at the upper deck 5. This change-over control device 21 comprises an air supply pipe 22 with a compressed air source (not shown in the drawings) connected to one end thereof, a pressure reducing valve 23 connected to the other end of the air supply pipe 22, first and second branch pipes 24, 25 which branch from the pressure reducing valve 23 and are connected to the first and the second feed and exhaust hoses 19, 20 respectively, a main switch valve 26 disposed in the course of the first branch pipe 24, an atmospheric exhaust pipe 28 which branches from the rear of the main switch valve 26 of the first branch pipe 24 and opens into the atmosphere via a switch valve 27, a first pressure gauge 29 disposed in the rear of the atmospheric exhaust pipe 28 of the first branch pipe 24, a cross valve 30 disposed in the course of the second branch pipe 25 and having an air source side communicating port 30*a*, a hose side communicating port 30*b* and an atmospheric opening 30*c*, a collecting pipe 32 which is connected at one end thereof to the atmospheric opening 30*c* of the cross valve 30 and opens at the other end thereof into a collecting container 31, such as a drum can, and a second pressure gauge 33 disposed in the rear of the cross valve 30 of the second branch pipe 25.

While the main switch valve 26 is opened, by putting the switch valve 27 in a closed state and by putting the cross valve 30 in such a state that the air source side communicating port 30*a* is closed and the hose side connecting part 30*b* and the atmospheric opening 30*c* communicates with each other, compressed air from the compressed air source which was reduced to a proper pressure by means of the pressure reducing valve 23 is supplied to the first feed an exhaust hose 19 via the first branch pipe 24, and the second feed and exhaust hose 20 communicates with the collecting container 31 via the second branch pipe 25 and the collecting pipe 32. On the other hand, while the main switch valve 26 is closed, by putting the switch valve 27 in an opened state and by putting the cross valve 30 in such a state that the atmospheric opening 30*c* is closed and the air source side communicating port 30*a* and the hose side communicating port 30*b* communicate with each other, compressed air from the compressed air source which was reduced in pressure by the pressure reducing valve 23 is supplied to the second feed and exhaust hose 20 via the second branch pipe 25, and the first feed and exhaust hose 19 communicates with the atmosphere via the first branch pipe 24 and the atmospheric exhaust pipe 28.

With the above arrangement, when the outward opening 6*a* of the ballast exhaust pipe 6 must be closed, the closing stopper 8 is inserted into the outward opening 6*a*, by opening the main switch valve 26 of the change-over control device 21, compressed air is supplied to the first feed and exhaust hose 19 and the bag body 9 is inflated outwardly in a diametrical direction, whereby the outward opening 6*a* is closed hermetically. On the other hand, fluid which leaked in the ballast exhaust pipe 6 is drawn out into the collecting container 31 via the communicating slender pipe 12 and the second feed and exhaust hose 20. When the outward opening 6*a* need not be closed, by putting the main switch valve 26 of the change-over control device 21 in a closed state, compressed air is supplied to the second feed and exhaust hose 20 to raise the pressure in the ballast exhaust pipe 6 via the communicating slender pipe 12, and by exhausting compressed air in the bag body 9 into the atmosphere via the first feed and exhaust hose 19, the bag body 9 is contracted inwardly in 1 diametrical direction and the closing stopper 8 is automatically taken out of the hull 1 from the outward opening *6a*. Numerals 34 and 35 are couplings for the first and second feed and exhaust hoses, respectively, to the first and second branch pipes, respectively.

Operating procedures and action of the above-mentioned first embodiment are explained below. In the case where there are leaks of oil from the ballast exhaust pipe 6 immediately after a ship, such as a tanker, enters a harbor and the outward opening *6a* must be closed, the closing stopper 8 is inserted into the outward opening *6a*. In this case, as the closing stopper 8 has an outside diameter smaller than the diameter of the opening *6a*, it can be inserted easily and therefore, even if the outward opening *6a* is below the surface of the water, it can be inserted without the service of a diver so far as it is slightly below the surface of the water. At this time, the first and the second connecting holes 13, 14 of the closing stopper 8 and the first and the second branch pipes 24, 25 of the change-over control device 21 on the upper deck 5 are connected with each other by the first and the 2nd feed and exhaust hoses 19, 20 beforehand and also the air supply pipe 22 of the change-over control device 21 is connected with a compressed air source (not shown in the drawings). Since a compressed air pipe is installed on the upper deck 5, the air supply pipe 22 can easily be connected to the compressed air source.

Under the above condition, in the change-over control device 21 after the switch valve 27 is set at "close", the cross valve 30 is put in such a state that the hose side communicating port **30*b* and the atmospheric opening 30*c* communicate with each other and the pressure reducing valve 23 is set at a proper pressure, the main switch valve 26 is opened. By this operation, compressed air reduced to a proper pressure flows into the bag body 9 of the closing stopper 8 via the first branch pipe 24 and the first feed and exhaust hose 19. Thus, the bag body 9** inflates outwardly in the diametrical direction and contacts tightly with the outward opening *6a* of the ballast exhaust pipe 6, partly due to the cylindrical shape maintaining action by the annular belt 16. The outer opening *6a* is closed hermetically, thereby preventing oil from leaking out of the opening *6a*.

After the closing stopper 8 is inserted, with the lapse of time, liquid which leaked in the ballast exhaust pipe 6 overflows the collecting pipe 32 via the communicating slender pipe 12, the second feed and exhaust hose 20, and the cross valve 30. By observing the extent of overflowing, we can detect the extent to which fuel oil has entered the ballast exhaust pipe 6 or the extent of leaks in the shutoff valve 7 in the pump room 2.

On the other hand, in the case where the closing of the outward opening *6a* of the ballast exhaust pipe 6 has become unnecessary immediately before or after departure of a ship, such as a tanker, from a port, and the closing stopper 8 is removed, in the change-over control device 21 the cross valve 30 is put in such a state that the air source side communicating port **30*a* and the hose side communicating port 30*b* communicate with each other so as to make compressed air flow into the ballast exhaust pipe 6 via the second branch pipe 25, the second feed and exhaust hose 20, and the communicating slender pipe 12. In this state, pressure in the bag body 9 and that in the ballast exhaust pipe 6 are equal and therefore the closing stopper 8** itself remains in the original position.

Then, after the main switch valve 26 is closed, the switch valve 27 is slightly opened while indicated pressures of the first pressure gauge 29 are being watched by an operator so as to reduce the pressure inside the bag body 9 and then the switch valve 27 is closed. By this operation, the bag body 9 contracts inwardly in the diametrical direction and the pressing force of the outer circumference of the bag body 9 and the annular belt 16 to the inner wall of the outward opening *6a* decreases. Thus, the closing stopper 8 is pressed by the air pressure in the ballast exhaust pipe 6, moves automatically toward the outside, and finally is pushed out of the hull 1. This change in pressure can be detected by the indicated pressure of the second pressure gauge 33 being reduced extremely but can also be confirmed by observing the binding member 18 or the closing stopper 8 itself from the side. Then, the closing stopper 8 can be drawn up to the upper deck 5 by utilizing the binding member 18. Thus, removal of the closing stopper 8 can be done automatically without manual labor, namely, time, labor and expenses for letting down a rope ladder, for launching and floating a work boat, and for sending down a diver can be dispensed with.

Figure 3:
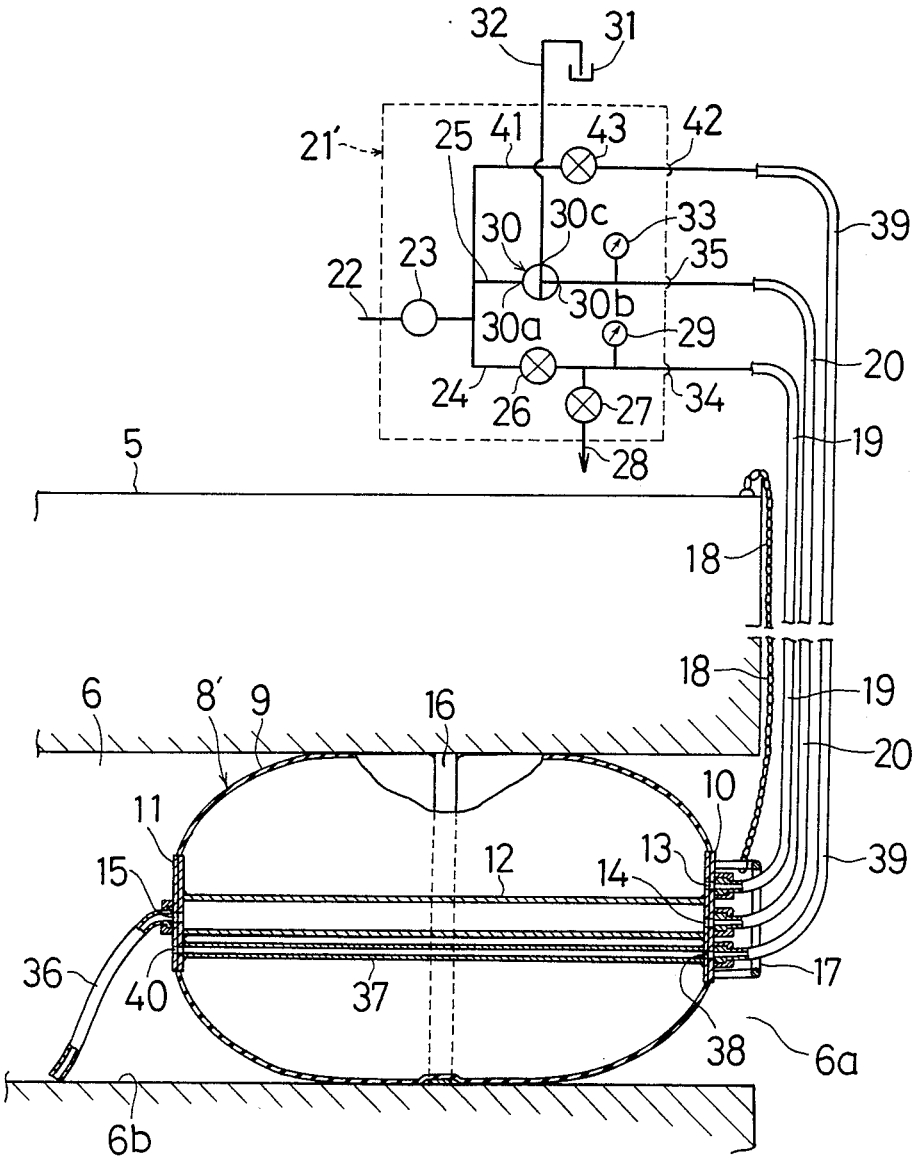
FIG. 3 shows the second embodiment in the same manner as FIG. 2.

FIG. 3 shows the second embodiment of the present invention (for the same parts as the first embodiment, same numerals are given and explanation of them is omitted). This embodiment is intended for extracting oil which leaked in the ballast exhaust pipe when the closing stopper 8 is inserted.

In this embodiment shown in FIG. 3, the closing stopper 8' is so composed that the other end of its communicating slender pipe 12 (the side facing the inside of the ballast exhaust pipe 6) opens toward the inner wall bottom part *6b* of the ballast exhaust pipe 6 through a short pipe 36 mainly comprising a pressure-resisting rubber hose. Provided in the closing stopper 8' is a communicating slender pipe 12 for an air supply 37 which connects both flanges 10, 11 and passes through the bag body 9 in its central longitudinal axis and almost in parallel with the above-mentioned communicating slender pipe 12. One end (the side facing the outside of the ship) of the communicating slender pipe 12 for the air supply 37 is connected with an air supply hose 39, mainly comprising a pressure-resisting rubber hose, via the third connecting hole 38 disposed at the flange 10 and the other end is so disposed that it communicates with the ballast exhaust pipe 6 via a communicating hole 40 made at the flange 11.

The other end of the air supply hose 39 is connected to the change-over control device 21'. In this change-over control device 21', a third branch pipe 41 which branches from the device at the rear of the pressure reducing valve 23 of the air supply pipe 22 is connected to the air supply hose 39 via a coupling 42. A switch valve 43 which is opened when the main switch valve 26 is in "open" operation is disposed in the course of the third branch pipe 41. When the outward opening *6a* of the ballast exhaust pipe 6 must be closed, the closing stopper 8' is inserted into the outward opening *6a* and by opening the main switch valve 26 by the operation of the change-over control device 21', compressed air is supplied to the first feed and exhaust hose 19 and the bag body 9 is inflated outwardly in the diametrical direction, whereby the outward opening 6a is closed hermetically. On the other hand, compressed air is supplied to the air supply hose 39 by the opening of the switch valve 43 and the air pressure in the ballast exhaust pipe 6 is raised through the medium of the communicating slender pipe for the air supply 37, whereby liquid which leaked in the ballast exhaust pipe 6 is drawn out into the collecting container 31 at the outside, via the short pipe 36, the communicating slender pipe 12, and the second feed and exhaust hose 20.

As stated above, in this embodiment when the outward opening 6a of the ballast exhaust pipe 6 must be closed, after the outward opening 6a is closed hermetically by the closing stopper 8', compressed air is supplied to the ballast exhaust pipe 6 via the third branch pipe 41, the air supply hose 39, and the communicating slender pipe for the air supply 37. Thus the air pressure in the ballast exhaust pipe 6 is raised. By this operation, liquid which leaked in the ballast exhaust pipe 6 overflows the collecting pipe 32, via the short pipe 36, the communicating slender pipe 12, the second feed and exhaust hose 20, and is collected in the collecting container 31. At this time, since the short pipe 36 provided at the other end of the communicating slender pipe 12 opens facing the inner wall bottom part 6b of the ballast exhaust pipe 6, fluid which leaked in the ballast exhaust pipe 6 can be drawn out entirely by such pressure raising action. Accordingly, when the closing stopper 8' is removed, fluid which leaked in the ballast exhaust pipe 6 can be prevented from flowing into the sea, with resultant prevention of seawater pollution.

As explained above, according to the present invention, when an outward opening of a ballast exhaust pipe for a ship, such as a tanker, is closed temporarily by a closing stopper so as to prevent leaks and flowing out of liquid from the outward opening, a closing effect by the closing stopper is enhanced and the outward opening can be sealed hermetically, with the result of perfect prevention of leaks and flowing out of fluid. Moreover, the present invention offers easiness of inserting and removing a closing stopper, especially automatic removing of a closing stopper, with resultant improvement of working efficiency and saving of work expenses. Furthermore, according to the present invention, the state of leaks in the ballast exhaust pipe can be detected and proper measures can be taken without delay against the cause of leakage, with resultant contribution to the prevention of seawater pollution at the harbor and at the coast.

A further advantage claimed for the present invention is that, since the present invention offers perfect extracting of fluid which leaked in the ballast exhaust pipe by pressure raising action in inserting a closing stopper, flowing of leaked fluid into the sea in removing the closing stopper can be prevented, with resultant prevention of seawater pollution.

What is claimed is:

1. A pipe closing appliance which closes temporarily an outward opening of a pipe, comprising:

a closing stopper which has two end faces and which is an inflatable, cylindrical bag body insertable in said outward opening, a first communicating slender pipe means for supplying compressed air and for withdrawing leaked fluid, said first pipe means passing through the bag body along a central longitudinal axis of the bag body, a first feed and exhaust hose connected at one end face of said closing stopper to said bag body such that both communicate with each other, a second feed and exhaust hose connected at one end face of said closing stopper to said first communicating slender pipe means such that both communicate with each other, a change-over control means, connected to ends of said two feed and exhaust hoses, for switching compressed air feed and exhaust for said two feed and exhaust hoses, a second communicating slender pipe means for supplying compressed air in said closing stopper in such a fashion that it is substantially in parallel with said first communicating slender pipe means and passes through the bag body, an air supply hose having one end connected to the second communicating slender pipe means and an opposite end connected to the change-over control means, and a short pipe extending from one end of the first communicating slender pipe means of the closing stopper to open facing an inner wall bottom part of the ballast exhaust pipe, whereby, when the outward opening must be closed, compressed air is supplied to said air supply hose by the operation of the change-over means and, by raising the air pressure in the ballast exhaust pipe through the second communicating slender pipe means, and any fluid which has leaked in the ballast exhaust pipe is drawn out by the short pipe into the first communicating slender pipe means for passage to the second feed and exhaust hose.

* * * * *